US006776656B2

(12) United States Patent
Lehtonen et al.

(10) Patent No.: US 6,776,656 B2
(45) Date of Patent: Aug. 17, 2004

(54) CONNECTION METHOD AND CONNECTION ARRANGEMENT

(75) Inventors: Pasi Lehtonen, Kempele (FI); Ossi Piirainen, Oulu (FI); Kimmo Huhtala, Oulu (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/612,341

(22) Filed: Jul. 3, 2003

(65) Prior Publication Data

US 2004/0063358 A1 Apr. 1, 2004

(30) Foreign Application Priority Data

Jul. 5, 2002 (FI) ..... 20021331

(51) Int. Cl.[7] ..... H01R 9/05
(52) U.S. Cl. ..... 439/578; 439/63; 439/581
(58) Field of Search ..... 439/578, 63, 59, 439/579–585, 944, 79, 675

(56) References Cited

U.S. PATENT DOCUMENTS 3,201,721 A * 8/1965 Voelcker ..... 333/33
3,539,966 A * 11/1970 Logan ..... 439/63
4,996,478 A * 2/1991 Pope ..... 324/754
5,532,659 A 7/1996 Dodart
5,897,384 A * 4/1999 Hosler, Sr. ..... 439/63
6,065,976 A 5/2000 Wang
6,407,652 B1 * 6/2002 Kan ..... 333/260
6,575,762 B2 * 6/2003 Evans ..... 439/63
6,639,154 B1 * 10/2003 Cartier et al. ..... 174/255

FOREIGN PATENT DOCUMENTS

WO WO 02/084808 10/2002

* cited by examiner

*Primary Examiner*—P. Austin Bradley
*Assistant Examiner*—Edwin A. Leon
(74) *Attorney, Agent, or Firm*—Squire, Sanders & Dempsey L.L.P.

(57) ABSTRACT

The invention relates to a connection method and a connection arrangement. The solution employs an adapter fastener, which is intended for both an adapter connection and a circuit board connection, the adapter fastener being electrically conductive. The adapter fastener comprises a hole, which extends through the adapter fastener and to which a coaxial cable is fixed. The sheath of the coaxial cable is electrically connected to the adapter fastener and a male connection is formed at the adapter fastener by means of an inner conductor of the coaxial cable. In the adapter connection, the inner conductor of the coaxial cable is connected electrically to a female contact of a standardized adapter and the adapter fastener is connected electrically to the frame of the standardized adapter by means of adapter protrusions. In the circuit board connection, the adapter fastener is fastened by means of circuit board protrusions to a circuit board and the adapter fastener is connected electrically by means of the circuit board protrusions to the earth of the circuit board. In addition, the inner conductor of the coaxial cable, used in the male connection, is connected electrically to an electrical conductor of the circuit board.

16 Claims, 3 Drawing Sheets

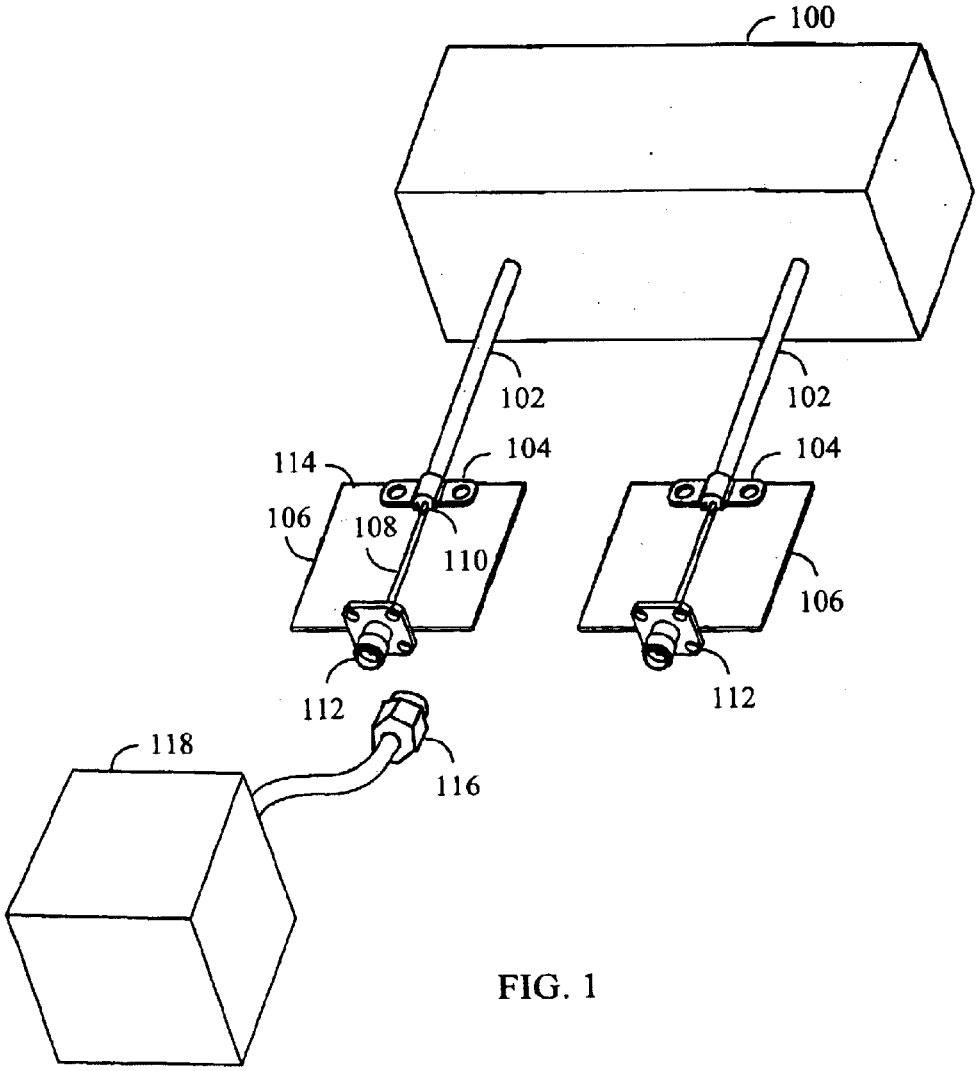
FIG. 1
FIG. 2
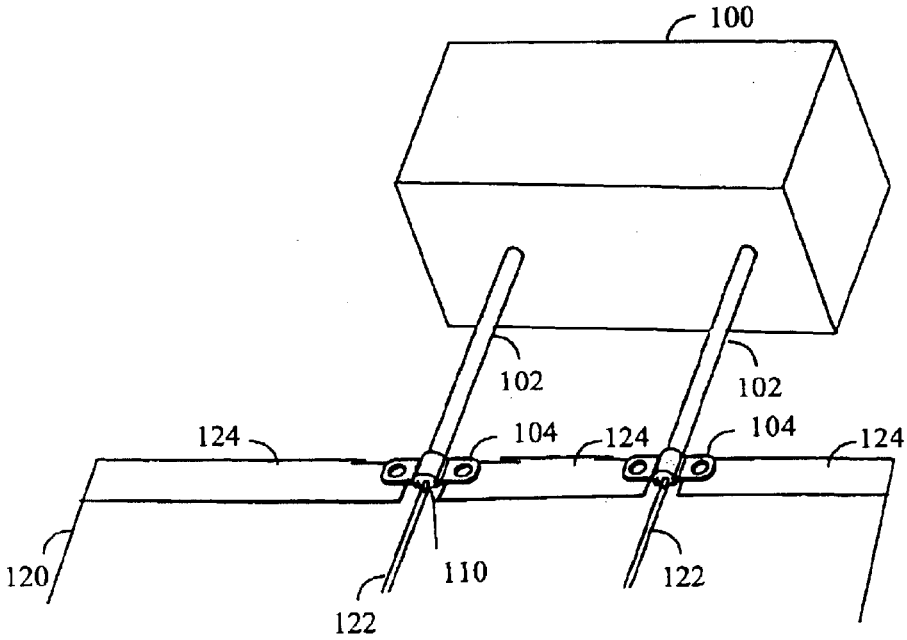

CONNECTION METHOD AND CONNECTION ARRANGEMENT

BACKGROUND OF THE INVENTION

1. Field of the Invention

The invention relates to connection of a semi-rigid coaxial cable provided with a single-core inner conductor in a high-frequency connection.

2. Description of the Related Art

Many electrical units, such as filters used in radio systems, must be tuned and tested before actually taken into use. It is thus necessary that in order to be tested, such a unit, component or machine part can be connected to a testing apparatus reliably and in an electrically similar way as to the circuit board of the actual system. This is especially important when high frequencies are applied. Between the units, components and machine parts there is often a coaxial cable, the other end of which is connected to the testing apparatus during testing, and when the unit is combined with a desired system, the end of the coaxial cable that was connected to the testing apparatus during testing is connected to the circuit board of the system.

However, it is not entirely uncomplicated to connect the coaxial cable to the testing apparatus and to the circuit board of the actual system, and thus a variety of supplementary parts are required for the connection, particularly when simple and inexpensive cable fasteners are to be used instead of expensive and large connectors. In a test measurement, a coaxial cable can be fastened by means of a separate fastener, for instance, to a test jig, which comprises a connector for connecting the testing apparatus. The coaxial cable is fastened similarly to the circuit board of the actual product as well. This solution is associated with many problems. A test measurement requires a separate test jig with connectors, which hinders the measurement and increases costs. In addition, the inner conductor of the coaxial cable must be soldered to the test jig and the earth conductor must be pressed to the test jig by screwing, for instance. Soldering is, however, a slow procedure. A separate test jig also produces differences between the connection of the test measurement and the circuit board connection during the actual use. This weakens the reliability of the measurement and affects the high-frequency properties of the system.

SUMMARY OF THE INVENTION

It is an object of the invention to provide a connection method and a connection arrangement implementing the method in such a manner that it is easier to carry out the connection to the testing environment and the reliability of the testing improves. This is achieved by a connection method intended for a high-frequency connection of a semi-rigid coaxial cable provided with a single-core inner conductor. The method further uses an adapter fastener, which is intended for both an adapter connection and a circuit board connection, the adapter fastener being electrically conductive; the adapter fastener comprises a hole which extends through the adapter fastener and to which the coaxial cable is fixed; the sheath of the coaxial cable is electrically connected to the adapter fastener and a male connection is formed at the adapter fastener by means of the inner conductor of the coaxial cable; in the adapter connection, the male connection is connected to a female connection of a standardized adapter by connecting the inner conductor of the coaxial cable electrically to a female contact of the standardized adapter and by connecting the adapter fastener electrically by means of adapter protrusions to the frame of the standardized adapter; and in the circuit board connection, the adapter fastener is fastened by means of circuit board protrusions to a circuit board and the adapter fastener is connected electrically by means of the circuit board protrusions to the earth of the circuit board; and the inner conductor of the coaxial cable, used in the male connection, is connected electrically to a desired electrical conductor of the circuit board.

The invention also relates to a connection arrangement arranged to be used for a high-frequency connection in a coaxial cable comprising a single-core inner conductor. The arrangement further comprises an adapter fastener intended for both an adapter connection and a circuit board connection; the adapter fastener comprises a hole which extends through the adapter fastener and to which the coaxial cable is fixed; the sheath of the coaxial cable is electrically connected to the adapter fastener and a male connection is formed at the adapter fastener by means of the inner conductor of the coaxial cable; for the adapter connection, the male connection is formed at a female connection of a standardized adapter and the inner conductor of the coaxial cable is arranged to be connected to a female contact of the standardized adapter; and the adapter fastener comprises adapter protrusions for fastening the adapter fastener to the standardized adapter and connecting the adapter fastener electrically to the frame of the standardized adapter; and for the circuit board connection, the adapter fastener comprises circuit board protrusions for fastening the adapter fastener to a circuit board and connecting the adapter fastener electrically to the circuit board; and the inner conductor of the coaxial cable, used in the male connection, is arranged to be connected electrically to the circuit board.

Preferred embodiments of the invention are disclosed in the dependent claims.

The invention is based on providing an end of a coaxial cable with an adapter fastener, at which a male connection from the inner conductor of the coaxial cable is formed for an adapter and circuit board connection.

The method and connection arrangement of the invention provide a plurality of advantages. The test measurement and connections between the system parts can be simplified and costs can be reduced. Also the reliability of the connection improves.

BRIEF DESCRIPTION OF THE DRAWINGS

In the following, the invention will be described in greater detail in connection with preferred embodiments, with reference to the attached drawings, in which FIG. 1 shows a test arrangement which requires separate testing means, FIG. 2 illustrates a situation corresponding to FIG. 1, whereby a coaxial cable is connected to a circuit board.

DESCRIPTION OF PREFERRED EMBODIMENTS

Figure 3:
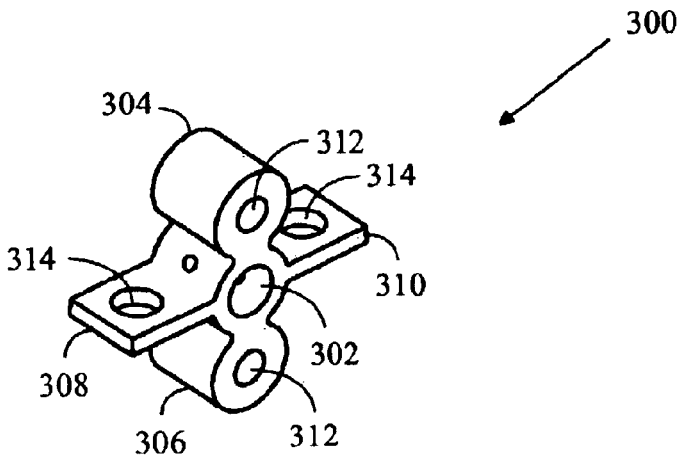
FIG. 3 shows an adapter fastener.

The shown solution is suitable for connecting a high-frequency component or a machine part by means of a coaxial cable to another component or machine part. The shown solution is particularly suitable for testing radio-frequency parts of a mobile telephone system and for the actual circuit board connection without, however, being restricted thereto.

FIG. 1 shows a prior art testing arrangement. A component or a machine part 100 is connected with at least one semi-rigid coaxial cable 102, via which the component 100 is tested. The testing arrangement requires plenty of testing means, which are, however, not required when the component 100 is connected to a circuit board of the actual product. They include a test jig 106 and a connector 112, the required number of which is one or more, depending on the number of coaxial cables. Each coaxial cable 102 is fastened to a fastener 104. With the fastener 104, the coaxial cable is fastened to the test jig 106. An inner conductor 110 of the coaxial cable is connected electrically, usually by soldering, to a conductor 108 on the test jig 106, the conductor being electrically connected to the central pole of the connector 112. Soldering, which is carried out for testing purposes, delays the testing. The sheath of the coaxial cable 102 is connected to the earth of the component 100 and therefore the sheath is connected to an earth conductor 114 of the jig. The earth conductor of the jig 106 is connected to the frame of the connector 112. The connectors 112 are used for connecting the component 100 via one or more connectors 116 of the testing apparatus to a testing apparatus 118.

FIG. 2 shows prior art connection of the component 100 to a circuit board 120 actually used. After the test arrangement is dismantled, the coaxial cable 102 can be fastened to a circuit board 120 of the actual product by means of the fastener 104, which can be the same as in the test arrangement. The inner conductor 104 of the coaxial cable 102 is connected electrically to a desired contact 122 of the circuit board 120 and the sheath of the coaxial cable is connected electrically to the earth 124 of the circuit board.

Let us now examine the shown solution by means of FIGS. 3 to 6. FIG. 3 shows an adapter fastener 300, which simplifies the test measurement and eliminates the need for using separate testing means. The adapter fastener 300 comprises a hole 302, to which the coaxial cable is placed and to the walls of which the sheath of the coaxial cable is connected electrically by soldering, for instance. The hole 302 is preferably in the middle of the adapter fastener 300, because it is advantageous to have a symmetrical structure in a high-frequency range. The adapter fastener 300 also comprises adapter protrusions 304 to 306 for fastening a standardized adapter to the adapter fastener. The adapter fastener also comprises circuit board protrusions 308 to 310 for fastening the adapter fastener to the circuit board. The adapter protrusions 304 to 306 and the circuit board protrusions 308 to 310 are preferably at a right angle to each other and have the same or approximately the same length. The circuit board protrusions 308 to 310 comprise holes 314, by which the adapter fastener 300 can be fastened with screws to the circuit board. Also the adapter protrusions 304 to 306 comprise holes 312, which are preferably provided with threads for a screw that fastens the adapter and the adapter fastener to each other. The central axes of the holes 312 of the adapter protrusions 304 to 306 are parallel to the central axis of the central hole 302, but compared with the central axes of the holes 314 of the circuit board protrusions 308 to 310, the central axes of the holes 312 of the adapter protrusions 304 to 306 are divergent and preferably at a right angle. In addition, the holes 312 of the adapter protrusions 304 to 306 and the holes 314 of the circuit board protrusions 308 to 310 are at an equal or almost equal distance from the central axis of the hole 302 intended for the coaxial cable. The adapter fastener 300 is made of an electrically conductive material. A suitable material is aluminum, which can be plated with silver, for instance. The adapter fastener 300 can be used for connecting a radio-frequency signal, in particular, with high power, thus allowing the cable to be used with the allowable power. However, the use of the adapter fastener 300 is not restricted by the frequency or power of the signal, but the restrictions depend upon the adapter used and the desired system to which the adapter fastener 300 is applied.

Figure 4:
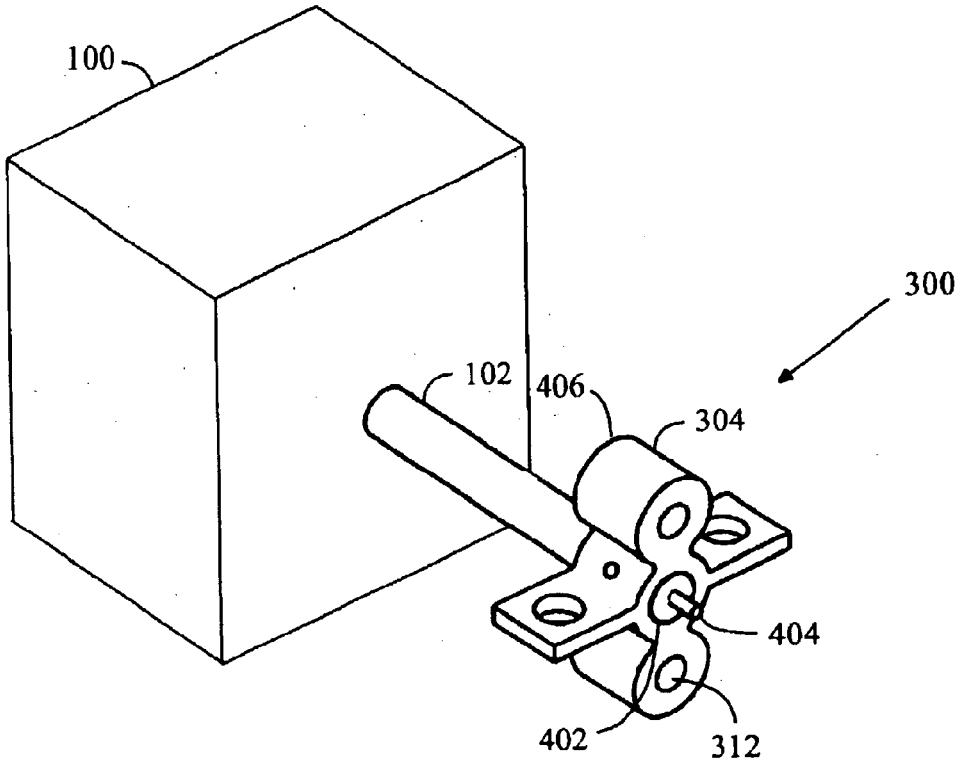
FIG. 4 shows the adapter fastener with its coaxial cables.

FIG. 4 illustrates the use of the adapter fastener 300 in a semi-rigid coaxial cable 102 provided with a single-core inner conductor 404, the other end of the cable being connected to an electrical component 100. An electrical connection 402 between the sheath of the coaxial cable and the wall of the central hole of the adapter fastener 300 can preferably be carried out by soldering. The coaxial cable is cut so that its end is on the same level as the end 406 of the adapter fastener, except that the inner conductor 404 of the coaxial cable extends outside the end 406 to the desired extent, thus forming a male connection. The adapter protrusions 304 to 306 can be made narrower in the area between the hole 302 intended for the coaxial cable and the holes 312 provided with threads. The narrowing can be seen in FIG. 4 in that the adapter fastener 300 seems to consist of three similar round bars symmetrically attached to each other, and in the middle of these bars there are holes 302 and 312. Due to the narrowing, conduction of heat to the adapter protrusions becomes weaker, and thus the soldering can be carried out more rapidly and the need for soldering power becomes smaller. Because of the narrowing, the adapter protrusions are also at least almost high-frequency symmetrical with the circuit board protrusions, because they have similar cross-sections. The high-frequency symmetry, for its part, improves the reliability of the connections, since the impedance is the same in the actual connection and in the test arrangement.

Figure 5:
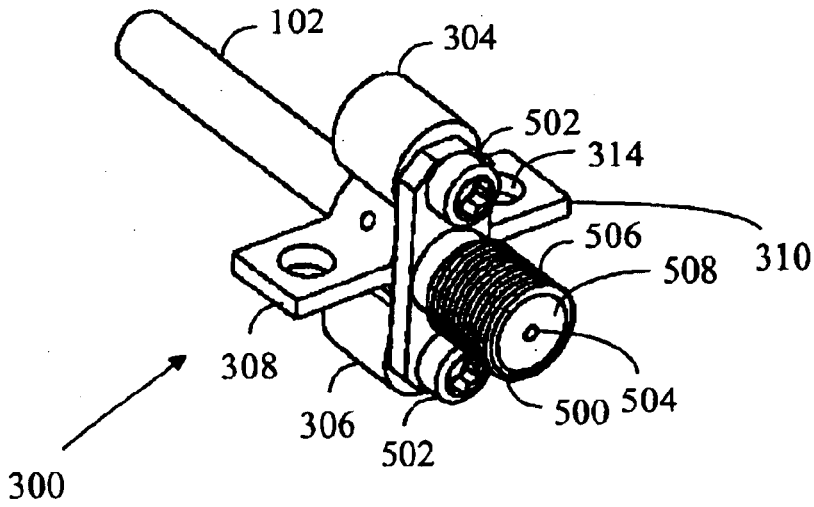
FIG. 5 shows the adapter fastener to which a standardized adapter is fastened.

FIG. 5 shows an adapter connection. An SMA adapter, for instance, can function as a standardized adapter 500. The adapter 500, which comprises a female connection at its end on the side of the adapter fastener 300, is pressed to the adapter fastener 300 so that the inner conductor of the coaxial cable is inserted into a contact hole 504 of the female connection, connecting the inner conductor and the female connection electrically to each other. As the adapter fastener 300 and the adapter 500 are fastened to each other with screws, electrical contact is also formed between the adapter fastener 300 and the frame of the adapter 500, functioning as earth contact. The adapter frame and the contact hole 504 of the female connection are separated electrically from each other by means of an insulator 508. The adapter use according to claim 5 is suitable, for instance, for testing a component or a machine part. In this case, a connector of the testing apparatus is fastened to the adapter 500 by utilizing potential threads 506, quick-disconnect connectors or the like of the adapter, for instance. Unlike in the figure, there can also be a male connection or a fixed cable connection on the side of the adapter 500 facing towards the viewer in FIG. 5.

Figure 6:
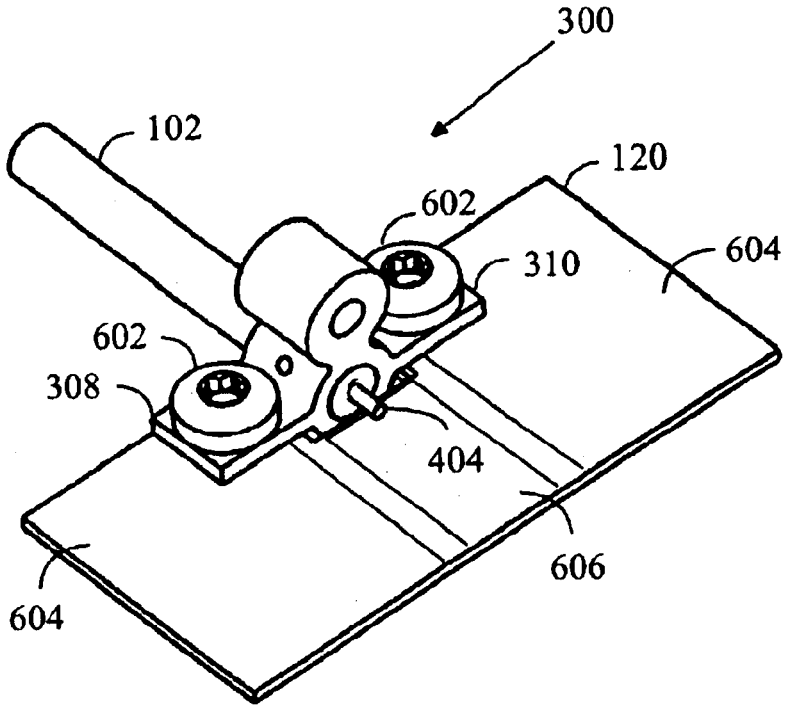
FIG. 6 shows a fastener, by which the coaxial cable is fastened to the circuit board.

FIG. 6 shows a circuit board connection. The adapter fastener 300 is fastened with screws 602 through the holes in the circuit board protrusions 308 to 310 to the circuit board 120 of the actual product. Simultaneously the circuit board protrusions 308 to 310 are tightly pressed against earth conductors 604 on the circuit board 120. The inner conductor 404 of the coaxial cable 102 is connected electrically to its conductor 606 on the circuit board by soldering, for instance, or by using a separate central pin on the circuit board.

Although the invention is described above with reference to the example according to the attached drawings, it is obvious that the invention is not restricted thereto, but can be modified in various ways within the scope of the inventive idea disclosed in the attached claims.

What is claimed is:

1. A connection method intended for a high-frequency connection of a semi-rigid coaxial cable provided with a single-core inner conductor, the method including:

using an adapter fastener, which is intended for both an adapter connection and a circuit board connection, the adapter fastener being electrically conductive;

wherein the adapter fastener comprises a hole which extends through the adapter fastener and to which the coaxial cable is fixed;

wherein the sheath of the coaxial cable is electrically connected to the adapter fastener and a male connection is formed at the adapter fastener by means of the inner conductor of the coaxial cable;

wherein in the adapter connection, the male connection is connected to a female connection of a standardized adapter by connecting the inner conductor of the coaxial cable electrically to a female contact of the standardized adapter and by connecting the adapter fastener electrically by means of adapter protrusions to the frame of the standardized adapter;

wherein in the circuit board connection, the adapter fastener is fastened by means of circuit board protrusions to a circuit board and the adapter fastener is connected electrically by means of the circuit board protrusions to the earth of the circuit board; and wherein the inner conductor of the coaxial cable, used in the male connection, is connected electrically to a desired electrical conductor of the circuit board.

2. A method as claimed in claim 1, wherein the standardized adapter is an SMA adapter.

3. A method as claimed in claim 1, wherein the adapter fastener is fastened with screws through holes in the circuit board protrusions to the circuit board.

4. A method as claimed in claim 1, wherein the adapter fastener is intended to be repeatedly connected and disconnected to and from both the adapter and the circuit board.

5. A method as claimed in claim 1, wherein the adapter fastener comprises two adapter protrusions and two circuit board protrusions; and the adapter protrusions are on the opposite sides of the hole of the coaxial cable and the circuit board protrusions are at a right angle to the adapter protrusions.

6. A method as claimed in claim 1, wherein the standardized adapter is fastened with screws to holes of the adapter protrusions, provided with threads.

7. A method as claimed in claim 6, wherein the adapter protrusions are made narrower in the area between a hole intended for the coaxial cable and the hole provided with threads.

8. A method as claimed in claim 6, wherein the adapter protrusions are made narrower in the area between the hole intended for the coaxial cable and the hole provided with threads.

9. A connection arrangement arranged to be used for a high-frequency connection in a coaxial cable comprising a single-core inner conductor, the arrangement further comprising:

an adapter fastener intended for both an adapter connection and a circuit board connection;

wherein the adapter fastener comprises a hole which extends through the adapter fastener and to which the coaxial cable is fixed;

wherein the sheath of the coaxial cable is electrically connected to the adapter fastener and a male connection is formed at the adapter fastener by means of the inner conductor of the coaxial cable;

wherein for the adapter connection, the male connection is formed at a female connection of a standardized adapter and the inner conductor of the coaxial cable is arranged to be connected to a female contact of the standardized adapter;

wherein the adapter fastener comprises adapter protrusions for fastening the adapter fastener to the standardized adapter and connecting the adapter fastener electrically to the frame of the standardized adapter;

wherein for the circuit board connection, the adapter fastener comprises circuit board protrusions for fastening the adapter fastener to a circuit board and connecting the adapter fastener electrically to the circuit board; and wherein the inner conductor of the coaxial cable, used in the male connection, is arranged to be connected electrically to the circuit board.

10. A connection arrangement as claimed in claim 9, wherein the standardized adapter is an SMA adapter.

11. A connection arrangement as claimed in claim 9, wherein the circuit board protrusions comprise holes, by which the adapter fastener is arranged to be fastened with screws to the circuit board.

12. A connection arrangement as claimed in claim 9, wherein the adapter fastener is arranged to be repeatedly connected and disconnected to and from both the adapter and the circuit board.

13. A connection arrangement as claimed in claim 9, wherein the adapter fastener comprises two adapter protrusions and two circuit board protrusions; and wherein the adapter protrusions are on the opposite sides of the hole of the coaxial cable and the circuit board protrusions are at a right angle to the adapter protrusions.

14. A connection arrangement as claimed in claim 9, wherein the adapter protrusions comprise a hole which is provided with threads and to which the standardized adapter is arranged to be fastened with screws.

15. A connection arrangement as claimed in claim 14, wherein the adapter protrusions are made narrower in the area between the hole intended for the coaxial cable and the hole provided with threads.

16. A connection arrangement as claimed in claim 14, wherein the adapter protrusions are made narrower in the area between the hole intended for the coaxial cable and the hole provided with threads.

* * * * *